US005111099A

United States Patent [19]

Smith

[11] Patent Number: 5,111,099

[45] Date of Patent: May 5, 1992

[54] APPARATUS AND METHOD FOR CONVERTING RADIOACTIVE ENERGY INTO ELECTRICAL ENERGY

[75] Inventor: Robert J. Smith, Peebles, Ohio

[73] Assignee: Genesis Energy Systems, Inc., Peebles, Ohio

[21] Appl. No.: 487,603

[22] Filed: Mar. 2, 1990

[51] Int. Cl.[5] ..... G21D 7/00; G21H 1/00

[52] U.S. Cl. ..... 310/305; 310/304; 136/202; 136/253; 429/5

[58] Field of Search ..... 310/304, 305; 429/5; 136/202, 253

[56] References Cited

U.S. PATENT DOCUMENTS

| | | | |
|---|---|---|---|
| 2,548,225 | 4/1951 | Linder | 310/304 |
| 3,663,360 | 5/1972 | Post | 310/301 |
| 3,668,065 | 6/1972 | Moir | 376/320 |
| 4,663,115 | 5/1987 | Russell | 310/304 |

*Primary Examiner*—Nelson Moskowitz

*Attorney, Agent, or Firm*—Frost & Jacobs

[57] ABSTRACT

There is provided an apparatus and method for converting radioactive energy into electrical energy, with the apparatus including an outer radioactive protective shell and a radioactive fuel source located within that shell. In a preferred embodiment, three mutually perpendicular magnetic fields are provided to separate alpha and beta particles emitted from the radioactive fuel source and to direct the alpha particles to a first predetermined region of the shell while directing the beta particles to a second predetermined region. An alpha collector is situated adjacent the first region to collect the alpha particles directed to that region, while a beta collector is situated within the second region to collect beta particles directed thereto. Structure is provided to permit removal of gaseous by-product from within the shell, and output leads are provided to utilize the collected alpha and beta particles to create electric current.

27 Claims, 5 Drawing Sheets

30(SEPARATOR)
31
32
33
90a
90b
90c
96c
96a
96b
90
88
40
42(SHELL)
96
122
87
86
26
44
85(g COLLECTOR)
52(a COLLECTOR)
70(b COLLECTOR)
54
112
114
74
78
20(FUEL)
87
123
120
105
LOAD
(LOAD)
121
89
115
113
95
93
46
91
103
55
23
108
104
100
LOAD
LOAD
LOAD
64
63
106
22
102
EARTH

APPARATUS AND METHOD FOR CONVERTING RADIOACTIVE ENERGY INTO ELECTRICAL ENERGY

TECHNICAL FIELD

This invention relates to an apparatus and method for converting radioactive decay energy into electrical energy, and, more particularly, to an improved apparatus and method for collecting emitted particles of radioactive decay and utilizing those particles to provide useable electrical current in a reliable and efficient manner.

BACKGROUND ART

A variety of devices and procedures for generating electrical energy from radioactive energy have been previously attempted by others with varying degrees of failure. However, the devices and procedures have been essentially directed to the utilization of only a single type of particle (i.e. the alpha, beta, or gamma particle) emitted from a particular nuclear energy source, and have understandably yielded very inefficient and impractical amounts of electrical energy.

For example, U.S. Pat. No. 4,178,524, which issued to J. Ritter on Dec. 11, 1979, describes a radioisotope photoelectric generator which relies solely upon photoelectric generation from gamma radiation emitted by a radioactive source. In particular, the Ritter device relies on photoelectric generation as a result of incident gamma radiation impacting a thin, high atomic number, or "high-Z", material which releases electrons as a result of the impact for capture by a thicker low atomic number, or "low-Z", material. Electrons captured by the low-Z material produce a potential difference build-up between adjacent sheets, and such potential is used to provide electric current. The inefficiency of the Ritter system, however, is specifically set forth in the specification where it is emphasized that one high-Z/low-Z pair of sheets will absorb only about 5% of the incident photons emitted by the radioisotope source. Moreover, devices such as described in Ritter require a custom tailored fuel source (e.g. one which emits gamma photons, but no high-energy charged particles), which can cause undue expense and difficulty in obtaining fuel.

Similarly, the devices set forth in U.S. Pat. Nos. 2,527,945 and 2,552,050, which issued to E. Linder on Oct. 31, 1950 and May 8, 1951, respectively, call for a single emitter source of fuel (i.e. either an alpha or beta particle emitter); U.S. Pat. No. 2,858,459, which issued to E. Schwarz on Oct. 28, 1958 calls specifically for a primary beta emitter; and U.S. Pat. No. 3,290,522, which issued to R. Ginell on Dec. 6, 1966 calls for a radioactive source of beta particles. Because these devices rely solely upon a single particle for generation of electrical energy, they are inherently inefficient and impractical in use. Specifically, requiring a primary emitter of only a single particular particle ignores the fact that radioactive decay necessarily transmutes elements through a chain or family of elements which may themselves emit particles other than the primary particle required in any particular device. It is virtually impossible to isolate a pure alpha or beta particle emitter unless it is the last element in a family chain just prior to stability. Failure to recognize this fact necessarily means that these devices generally fail to take advantage of two of the three particles commonly emitted during radioactive decay.

Specifically, the devices set forth in the Linder '050 and '945 patents require shielding the radioactive source to ensure that only alpha particles or beta particles (but not both) are permitted to impact the collector electrode of the device. As it is understood that radioactive material will emit both alpha and beta particles, Linder attempts to minimize the natural neutralization of the charge build-up on the collector electrode if both particles were permitted to impact the electrode. Consequently, the shielded particles are essentially wasted in the process.

The Schwarz '459 disclosure describes situating a primary beta emitter source within a highly evacuated spherical radiation collector. While the Schwarz device utilizes a secondary emitter provided between the primary beta emitter and the collector to attempt to increase the efficiency of the device, the device by its nature is only equipped to utilize one particular particle, and requires a highly specialized fuel source.

The electrical generator set forth in the Ginell '522 reference contemplates the generation of electrical power by modulating the density of a cloud of charged beta particles confined within a glass sphere having an inner surface coated with silver. The hollow sphere and its silver lining are connected to a gas discharge tube, and the beta particles or electrons emitted by the radioactive source are collected by the silver lining and accumulate thereon to create an electrostatic charge between the silver lining and the hollow sphere. When this electrostatic charge reaches a given value, the discharge tube fires, equalizing the potentials of the sphere and the lining and allowing the cloud of charged particles to expand within the sphere. As the electrostatic charge begins to build again, the cloud of charged particles is compressed until the discharge tube again fires. The variation in density of the cloud of charged particles cuts an electrically conductive means to create an electric potential and current in accordance with Faraday's Law of Induction. Consequently, the Ginell device operates in a manner similar to a transformer and relies on a single emitted particle. The specification of Ginell further specifically recognizes a 50% loss of efficiency due to self-absorption and capture of charged particles by the spherical shell.

More recently, in acknowledgment of the fact that there has been a rapid increase over the years in the amount of radioactive substances available in the wake of atomic energy power generation, research has been carried out to try to find uses for these radioactive substances and for the conversion of radioactive energy into electric energy. U.S. Pat. No. 3,939,366, which issued to Y. Ato et al. on Feb. 17, 1976 discloses a two-step converting-type system wherein radioactive energy is used to induce a physical phenomenon which is, in turn, used to produce electric. The Ato device requires processed fuel for providing either an alpha particle source or a low energy beta particle source. This radioactive source of primarily a single type of particles is used to release electrons within a converter body, and a magnetic field is used to guide those released electrons to a particular electrode for collection. In addition to requiring a particular primary emitter source of processed fuel, this device is additionally inefficient as it makes use of only a single axial plane of emission of particles, thereby wasting a high percentage of that single type of particle.

U.S. Pat. No. 4,835,433, which issued to P. Brown on May 30, 1989, discloses a rather complex assembly of elements to form an equivalent resonant circuit utilizing an array of capacitors, inductors and transformer windings to convert radioactive energy in the form of alpha particles or beta particles into electrical energy. In particular, Brown contemplates utilization of a radium needle surrounded by a cylinder of thorium having a plurality of uranium rods positioned therewithin, all surrounded by a series of transformers and with the entire unit being placed in an oil filled can with heat sinks. The Brown device assumes that there is no direct current resistance and fails to take advantage of particles emitted by the radioactive source in planes which do not intersect with the electrical circuitry of the device. Similarly, Brown is inherently inefficient in relying on only a single type of emitted particle from the radioactive source, and by creating electrical energy only indirectly through a transformer closed circuit configuration. Additionally, the Brown apparatus calls specifically for heat sinks to absorb thermal energy produced by the system, thereby wasting an additional source of electrical current.

Additionally, many of the devices heretofore available for converting the products of radioactive decay into electrical energy have failed to take into account the fact that when alpha particles strike any atom with an atomic number greater than 19, the result is ionization and the creation of helium atoms which are generally incapable of chemically combining with other materials within these devices. Consequently, the build up of helium gas within these systems is generally unavoidable, and could eventually impede the operation and/or cause unsafe pressure buildups therewithin. Moreover, the devices previously available have relied upon the theoretical use of pure radioactive material which emit only a single type of particle. In fact, radioactive decay generally provides for the emission of alpha, beta and gamma photons or particles (the terms "gamma particles" and "gamma photons" will be used interchangeably herein) which, by their very nature, tend to neutralize each other reducing by up to 50% the useable power (i.e. the potential difference within the system) and the overall efficiency thereof.

As a result, heretofore there has not been available in the industry an efficient device for converting atomic energy into electrical current, nor devices which are capable of taking advantage of more than one of the various particles commonly released during radioactive decay in order to produce more energy from the same amount of source material. Similarly, while it has clearly been recognized in the industry that simple, reliable and efficient atomic "batteries" are desirable, none of the apparatuses or methods previously available have adequately responded to this need.

DISCLOSURE OF THE INVENTION

It is an object of this invention to obviate the above-described problems and shortcomings of devices and methods for converting radioactive decay energy into electrical energy heretofore available in the industry.

It is another object of the present invention to provide an improved apparatus and method for converting radioactive energy into electrical energy which takes advantage of a plurality of the particles emitted during radioactive decay.

It is yet another object of the present invention to provide an apparatus and method for converting radioactive energy into electrical energy which includes means for separating alpha and beta particles emitted from a radioactive fuel source so that substantially all of these particles can be separately collected for producing an electric current. It is also an object of the present invention to provide a more efficient atomic particle battery which can utilize substantially all of the particles emitted from a radioactive fuel source to provide electric current.

In accordance with one aspect of the present invention, there is provided an apparatus for converting radioactive energy into electrical energy, with such apparatus including an outer radioactive protective shell and a radioactive fuel source located within that shell. In a preferred embodiment, three mutually perpendicular magnetic rings are provided to separate alpha and beta particles emitted from the radioactive fuel source and to direct the alpha particles to a first predetermined region of the shell while directing the beta particles to a second predetermined region. An alpha collector is situated adjacent the first region to collect the alpha particles directed to that region, while a beta collector is situated within the second region to collect beta particles directed thereto. Structure is provided to permit removal of gaseous by-product from within the shell, and output leads are provided to utilize the collected alpha and beta particles to create electric current.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE INVENTION

Figure 1:
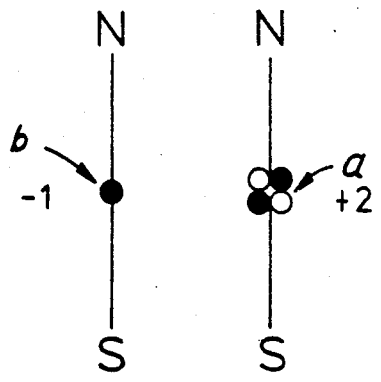
FIG. 1 is an illustration showing the particle magnetic field of alpha and beta particles in motion.

Referring now to the drawings in detail, wherein like numerals indicate the same elements throughout the views, FIG. 1 illustrates a theoretical, simplified view of an alpha particle a and a beta particle b, showing the electrical charges on each and the particle magnetic field created by these respective particles in motion. This diagram is simply to illustrate the fact that a beta particle (or electron) b comprises an electrical charge of negative one and creates a particle magnetic field having an effective north and south pole when in motion, while the alpha particle a is much larger than the single electron or beta particle, has an electrical charge of positive two, and also creates an effective north and south pole as it moves in rotation. As a result of the inherent electrical charges of alpha and beta particles, the paths of travel of these respective particles can be physically altered by the imposition of an effective magnetic field onto the moving particles.

Figure 2:
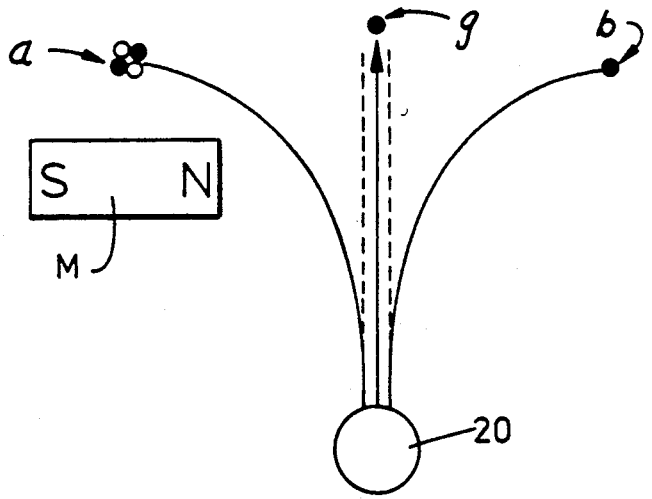
FIG. 2 is a schematic representation showing the effects of a magnetic field upon alpha, beta and gamma particles emitted from a radioactive fuel source.

In particular, FIG. 2 illustrates the effect of a magnetic field imposed by magnet M on alpha, beta, and gamma particles (a, b and g, respectively) emitted from a radioactive fuel source 20. As indicated, the positively charged alpha particle a will be drawn off of its straight line path by the imposition of an effective north pole magnetic field, causing alpha particle a to veer sharply in the direction of that north pole. Conversely, the negatively charged beta particle b is repelled by the imposition of an effective north pole, and is oppositely diverted from its straight line path sharply away from such pole. The neutrally charged gamma photon g is not affected by the imposition of a magnetic field into its line of travel, and remains on its original straight line path, as indicated.

Figure 3:
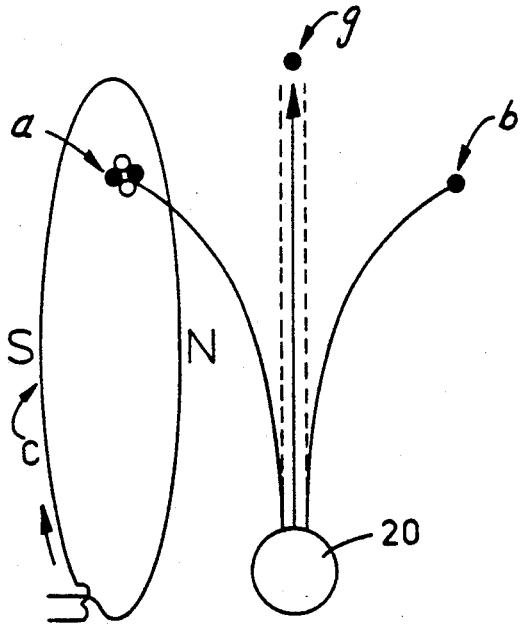
FIG. 3 is a schematic illustration similar to FIG. 2, showing a magnetic field induced by an electromagnetic device and its effect on alpha, beta and gamma particles emitted from a radioactive fuel source.

FIG. 3 indicates the similar effect upon the alpha and beta particles (a and b) as a result of the imposition of an effective north pole along the straight line paths of travel of these particles. The magnetic field illustrated in FIG. 3 is provided by an electromagnetic coil C through which current is provided in a clockwise direction to create an effective north pole facing inwardly toward the straight line paths of the atomic particles.

Figure 4:
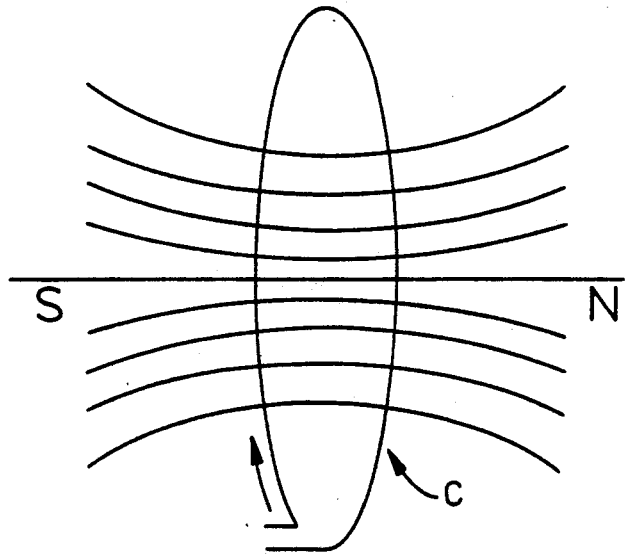
FIG. 4 is an illustration of the magnetic field flux lines induced by an electromagnetic coil, emphasizing the compressive characteristics of such a magnetic field.

It has been found that magnetic flux lines provided by magnetic fields as induced, for example, through electromagnetic coil C tend to be inwardly compressive along a line (e.g. a polar axis) connecting the effective north and south poles, as illustrated in FIG. 4. It is also known that radioactive elements emit particles in substantially all directions during radioactive decay.

While FIGS. 2 and 3 illustrate that the imposition of a magnetic field can serve to guide or direct alpha and beta particles traveling in a direction substantially normal to the effective polar axis created by a magnetic source (e.g. magnet M or electromagnetic coil C), imposition of a single magnetic field such as shown in FIGS. 2 and 3 would effect only a small portion of the atomic particles emitted from radioactive source 20.

In fact, it has been found in the present invention that to effectively separate and direct alpha and beta particles to predetermined collection zones, it is necessary to provide a means which can impose an effective magnetic field (or fields) which will control and affect the direction of alpha and beta particles in all three dimensions. Particularly, because alpha and beta particles (a and b) will be emitted from radioactive fuel source 20 in substantially all directions, means for separating the particles, and directing the separated particles to predetermined zones must be capable of effecting alpha and beta particles moving in any outward direction from radioactive source 20.

Figure 5:
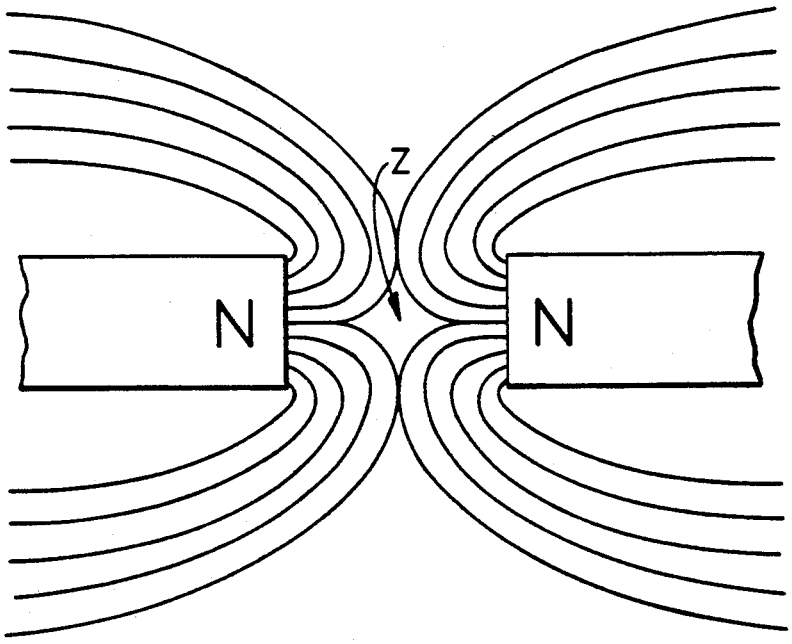
FIG. 5 is a schematic illustration of the interaction of magnetic flux lines of adjacent like poles of two magnets.
Figure 6:
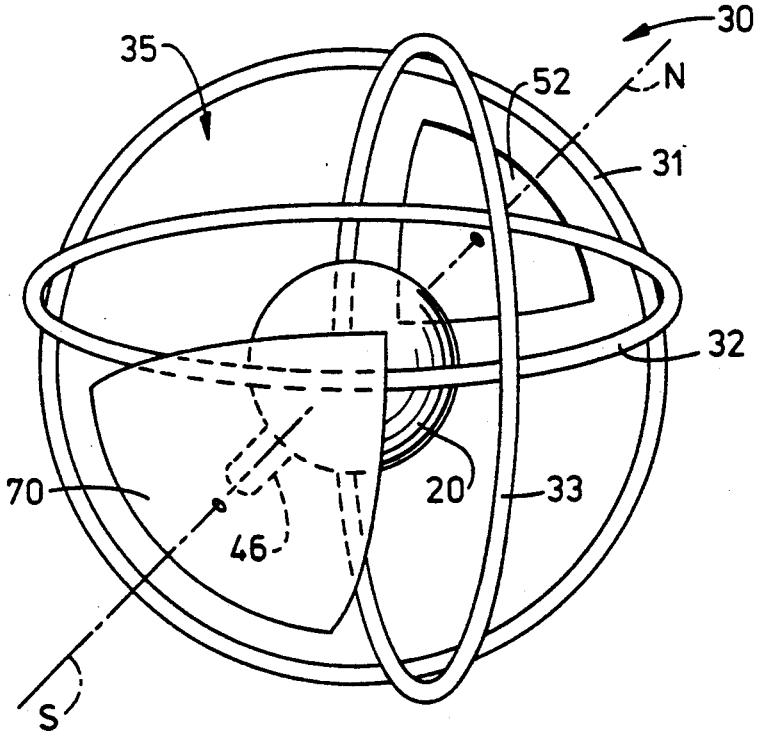
FIG. 6 is a schematic illustration of a preferred arrangement of triaxial, offset magnetic rings which can be utilized to separate alpha and beta particles in the present invention.

It has been found that by placing like poles of two magnetic means (as used herein the term "magnetic means" connotes any device for effectively providing a magnetic field) in face-to-face relationship, a central eye or zone Z is formed by the opposing magnetic flux along the length of the facing magnetic devices. FIG. 5 illustrates schematically the interaction of opposing flux lines from like poles of two adjacent magnetic means, with eye or zone Z formed therebetween. In the present invention, it is preferred to utilize this magnetic phenomenon to provide a means for separating alpha and beta particles emitted from radioactive fuel source 20. As illustrated in FIG. 6, it has been found that by providing three triaxial, mutually perpendicular magnetic rings (e.g. 31, 32 and 33), an effective means 30 for separating alpha and beta particles can be provided to a predetermined volume 35 within those magnetic rings. As will be seen, by placing the radioactive fuel source 20 within volume 35 of means 30 for separating alpha and beta particles, the separation and direction of travel of substantially all of the alpha and beta particles emitted from source 20 can be accomplished.

Figure 7:
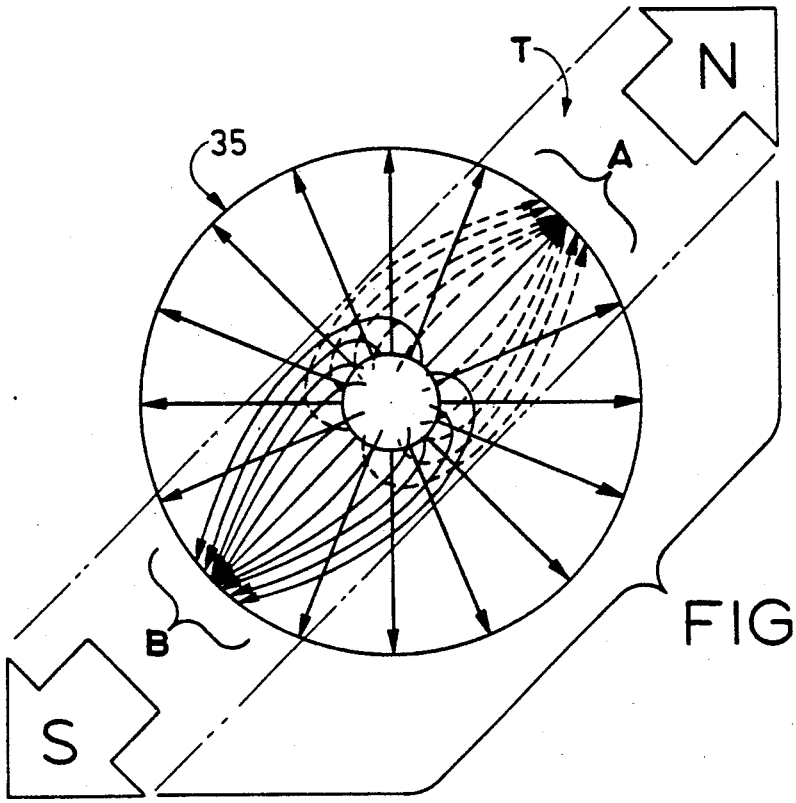
FIG. 7 is a diagrammatic depiction of the separation and direction of alpha and beta particles as contemplated herein.

Volume 35 within magnetic rings 31, 32 and 33 is illustrated schematically in FIG. 7 in simplified (planar) form. By providing each of the magnetic rings 31, 32 and 33 with their effective north poles facing inwardly toward the center of volume of 35, it has been found that a magnetic field tunnel T similar to the eye or zone Z illustrated in FIG. 5 is formed in three dimensional space within volume 35. In particular, the triaxial, mutually perpendicular magnetic rings of means 30 provide inwardly compressive flux lines as illustrated in FIG. 4 which press inwardly to form an effective three dimensional magnetic field tunnel T, which itself has an effective north and south pole at opposite ends, as indicated. It should be noted that magnetic rings 31–33 could similarly have their effective south poles oriented inwardly, with the effective north and south poles simply being reversed on FIG. 7.

Because magnetic field tunnel T includes an effective north pole and effective south pole along a magnetic or polar axis, as illustrated in FIGS. 2 and 3, alpha particles a will be effectively directed toward that north pole while beta particles b will be directed toward the south pole. As a result, alpha particles will be effectively separated from beta particles, as each will be strongly directed toward opposite regions within volume 35. Particularly, alpha particles will be drawn toward a first predetermined region A, while beta particles will be directed to a second predetermined region B located at opposite ends of the magnetic field tunnel T. As mentioned, the gamma particles (or gamma photons) g are unaffected by magnetic fields and will travel along substantially straight line paths in an outward direction. While any means for separating the alpha and beta particles and directing them to predetermined regions of volume 35 can be utilized, it is believed that the three mutually perpendicular magnetic rings of the present invention may be preferred as a relatively simple and efficient device to accomplish this function.

As illustrated in FIG. 6, the mutually perpendicular magnetic rings are preferably offset (e.g. ten degrees) from the center of battery 40 in order to create a magnetic field tunnel T which will tend to separate the alpha and beta particles and direct them outwardly in opposite directions along tunnel T. If the magnetic rings were perfectly centered around the fuel source, the resultant magnetic field would not be a magnetic field tunnel as desired, but would tend to be a perfectly centered "sphere" of magnetic flux which would tend to hold all of the alpha and beta particles adjacent the center of volume 35 in magnetic suspension.

Because the intention of the present invention is to separate the alpha and beta particles from one another, and utilize those particles to create electric current, it is imperative that the alpha and beta particles be directed from radioactive source 20 to predetermined regions (e.g. A and B) for collection and use. The exact degree of offset is not believed to be critical, as long as there is sufficient offset of the rings to facilitate separation and collection of the alpha and beta particles. As shown in FIG. 6, rings 31–33 have been slightly offset in a direction toward the upper right hand quadrant, thereby orienting the effective north pole of the resultant magnetic field tunnel with its effective north pole in the direction indicated (assuming rings 31–33 are oriented with their effective north poles facing inwardly).

Figure 8:
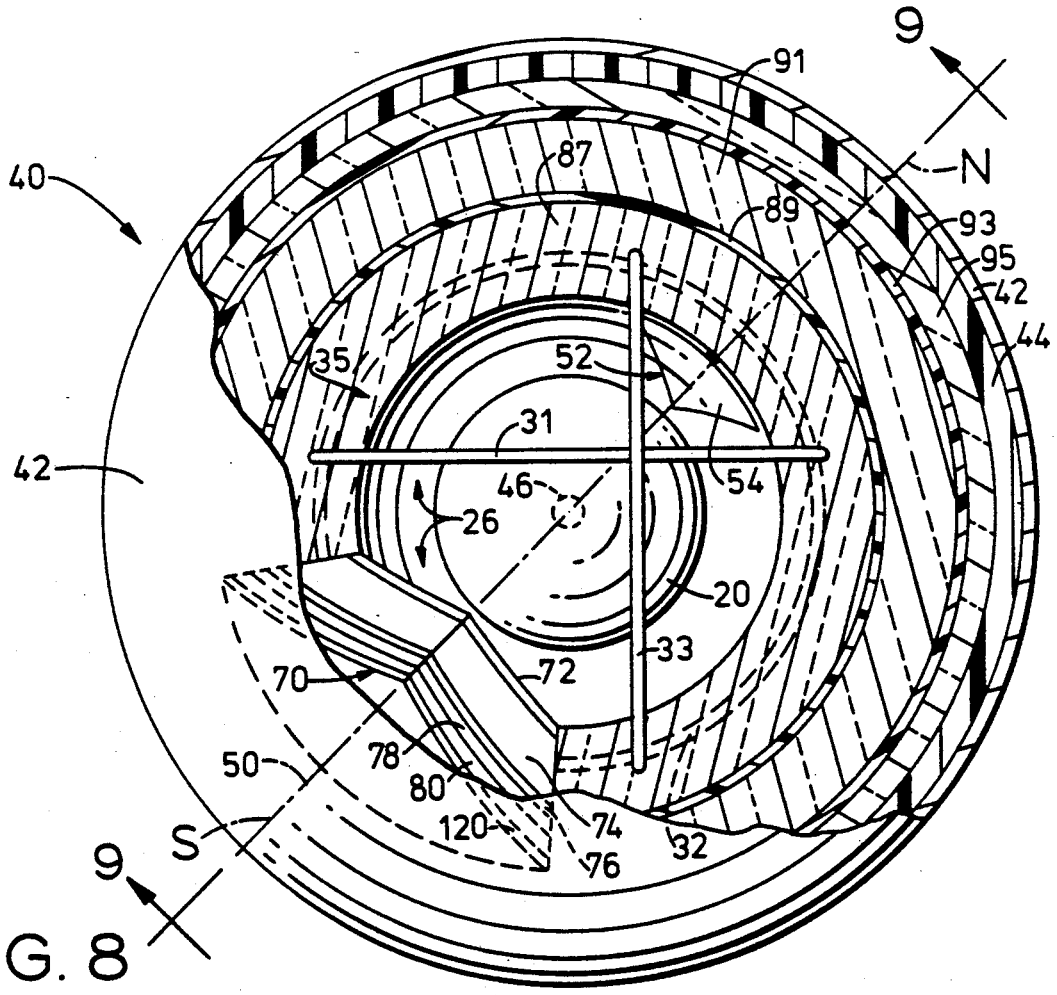
FIG. 8 is a partial cross-sectional view of a preferred embodiment of an apparatus made in accordance with the present invention.
Figure 9:
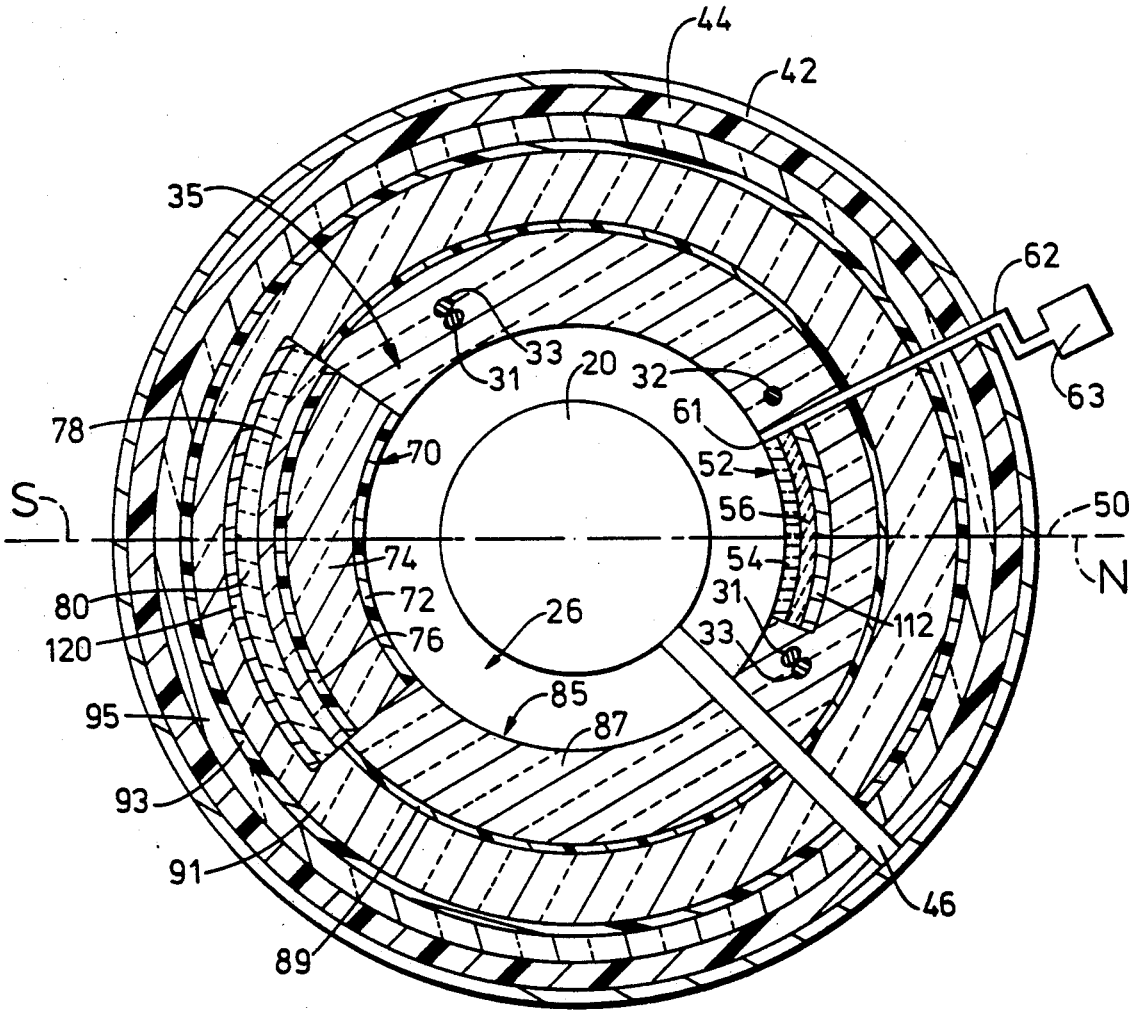
FIG. 9 is cross-sectional view of the apparatus of FIG. 8, taken along line 9—9 thereof.
Figure 10:
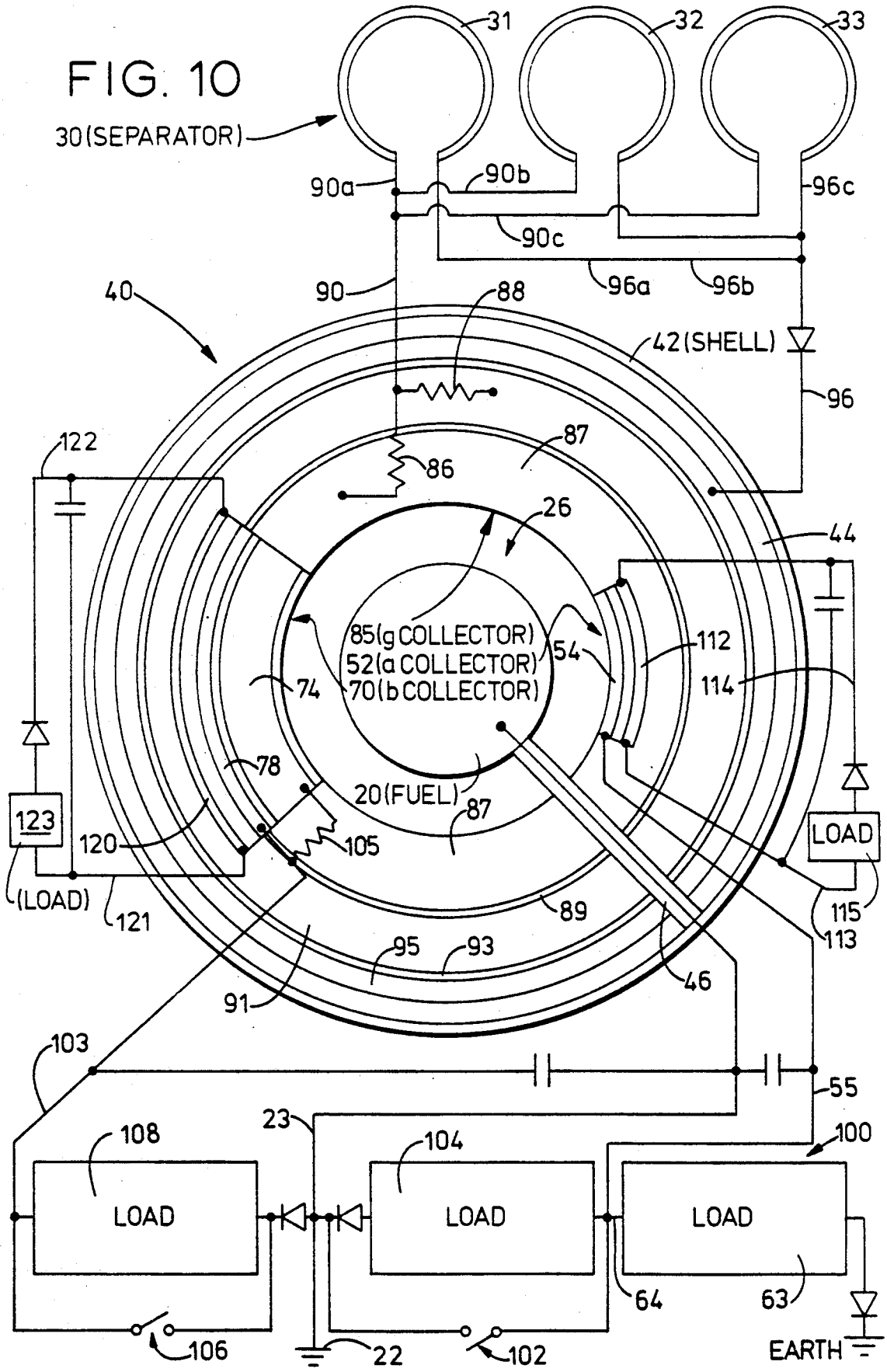
FIG. 10 is a schematic electrical layout drawing showing a preferred arrangement of the atomic particle battery of the present invention.

FIGS. 8–10 illustrate a preferred embodiment of an atomic particle battery 40 of the present invention. In particular, FIGS. 8 and 9 illustrate atomic particle battery 40 as including a radiation shielding layer or outer protective shell 42, essentially enveloping the entire battery to prevent the inadvertent leakage of radioactive energy. It is contemplated that protective shell 42 may have varying thicknesses and outer shape depending upon the particular application. Moreover, any material such as lead, which can positively prevent the escape of the products of radioactive decay (i.e. alpha, beta, and gamma particles), can equally be employed for shell 42.

Covering the interior surface of protective shell 42 is preferably an electrically insulating layer 44, preferably formed of polymeric material or similar electrically insulating material. Insulating layer 44 serves to isolate the interior battery elements from protective shell 42. Preferably mounted centrally within protective shell 42 is a source of radioactive energy or fuel 20 which can be radioactive fuel of any nature, such as atomic power plant waste or naturally occurring radioactive elements or isotopes. Such elements emit alpha and beta particles in approximately equal numbers.

Radioactive fuel source 20 is preferably centrally mounted within battery 40 by one or more support rods 46 rigidly connected to protective shell 42. Support rod 46 is preferably formed of a radiation inert material such as plastic, graphite, or the like. As can be understood, however, it is preferred to utilize material which can conduct current, such as graphite, to facilitate the provision of a bipolar battery which may be more easily adaptable to a variety of applications.

Mounted peripherally and radially outwardly from fuel source 20 is means 30 for separating alpha and beta particles. As described above, means 30 preferably comprises a triaxial set of three mutually perpendicular magnetic rings 31, 32, and 33, respectively, for providing three mutually perpendicular ring-like magnetic fields having like poles facing inwardly into the center of shell 42. As described above, these magnetic rings establish a magnetic field tunnel T having an effective north and south pole at opposite longitudinal ends thereof. The effective north and south poles are indicated along the longitudinal polar axis 50 of magnetic field tunnel T in FIG. 9.

Located adjacent the periphery of volume 35, at substantially opposite ends of longitudinal polar axis 50 are alpha collector 52 and beta collector 70, respectively. In particular, because alpha particles will be directed toward the effective north pole along polar axis 50 of tunnel T, alpha collector 52 is located adjacent the outer periphery of volume 35 radially outwardly from fuel source 20 toward the effective north pole of tunnel T. Alpha collector 52 is also preferably substantially centered along polar axis 50 to collect alpha particles. Correspondingly, beta collector 70 is located in the opposite hemisphere from alpha collector 52, adjacent the periphery of volume 35 radially outwardly from fuel source 20 and substantially centered along polar axis 50 in the direction of the effective south pole. As will be understood, location of the collector devices in this manner enables substantially all of the separated alpha and beta particles to be collected and utilized for the production of electric current.

Alpha collector 52 is preferably provided with a collector surface having very low ionization potential to facilitate the neutralization of charge on the alpha particle captured. Additionally, the alpha collector should be formed of a material having an atomic number higher than 19 so that the nuclear ionization potential will prevent the alpha particles from interacting with the nucleus of the collector atom, thereby preserving the atom's integrity.

Other requirements for the alpha collector include having a small covalent or atomic radius to thereby expose the most collector atoms to the impinging alpha particle, and thereby easing electron mobility; having a high melting temperature in order to withstand heat buildup which can be caused by kinetic energy of the colliding alpha particles with the collector atoms, and by the flow of current from the collector; and the ability of the material to form high strength bonds with a thin film of aluminum so as to provide a limited amount of "cushioning" to the collected alpha particle and to lower the possibility of X-ray emissions resulting from such collision, and because aluminum is an electron acceptor which can ease the transition of electrons from the collector to the alpha particle as required. A preferred alpha collector material is pure Calcium.

Calcium collector surface 54 is shown in FIG. 9 as being preferably bonded to an insulator layer 56 such as ceramic material or Barium Titanate. Insulator layer 56 serves to electrically insulate Calcium collector surface 54 from the surrounding elements of battery 40. A thermo-pile or thermo-generator 112 capable of deriving electric current from the heat built up within alpha collector 52 as a result of the kinetic energy imparted by colliding alpha particles may also preferably be mounted adjacent alpha collector 52 (e.g. connected to insulator layer 56 as seen in FIGS. 9 and 10). While the exact size (or surface area) of alpha collector surface 54 may vary between applications, the overall area is preferably kept to a minimum so that collection of gamma photons can be maximized. It is contemplated that alpha collector surface 54 would not cover more than approximately 12.5% of the total available inner surface area of the imaginary sphere bounding volume 35 of battery 40.

Located in the opposite hemisphere within shell 42, radially outwardly from fuel source 20 and substantially centered along polar axis 50, is beta collector 70. It is contemplated that a preferred beta collector 70 would comprise an innermost layer 72 of energy absorbing material such as polystyrene, which could be located equidistant from the center of fuel source 20 relative to alpha collector surface 54. It has been found that a polystyrene or similar energy absorbing material can effectively slow down the higher energy electrons to facilitate their capture by a first secondary emitter surface 74, preferably formed of Sodium Chloride. This first secondary emitter surface 74 is, in turn, bonded to a second layer 76 of energy absorbing material such as polystyrene. Energy absorber layer 76 is, in turn, preferably bonded to beta collector surface 78. Upon impact of a beta particle with emitter surface 74, a plurality of electrons will usually be released for collection by collector surface 78.

Beta collector surface 78 is preferably formed of a high electro-positivity material such as Sulphur in order to provide a collector having substantial affinity for holding the electrons and beta particles to be captured. As with alpha collector 52, it is contemplated that beta collector 70 would also include an insulator portion 80 such as Barium Titanate, with a thermo-generator or thermo-pile 120 provided to take advantage of heat produced by kinetic energy of particle collision.

As seen in FIG. 10, it is contemplated that secondary emitter surface 74 will preferably be electrically connected to beta collector surface 78 so as to provide a small negative electrical bias to secondary emitter surface 74 to help prevent low energy beta particles from drifting radially inwardly toward fuel source 20, and to enable some electrons to flow back to emitter 74 to replenish displaced electrons. As described above, energy absorber layer 72 and 76 serve to slow down or control the high energy electrons and facilitate their ultimate capture by beta collector surface 78.

The overall size of beta collector 70 may vary between applications, but is preferably approximately twice as large (in area) as alpha collector 52. The larger size is preferred, in part, to accommodate the spreading of the magnetic field in the direction of beta collector surface 78. As will be understood, magnetic rings 31–33 are to be offset slightly from the center of volume 35, and this offset is preferably in a direction toward alpha collector surface 54. Inversely, the center of the magnetic axis of rings 31–33 will then be slightly further away from beta collector surface 78. This distance will naturally allow magnetic tunnel T to taper slightly outwardly in the direction of beta collector 70, and therefore allows for slightly increased spreading of the magnetic field and the beta particles as they are directed toward collector surface 78. Beta collector 70 is made larger to accommodate these characteristics and to ensure maximum collection of the beta particles.

As indicated in FIGS. 8–10, there is preferably provided some limited open space 26 surrounding fuel source 20. Space 26 enables alpha and beta particles emitted from fuel source 20 to be effectively separated and directed toward the predetermined regions within battery 40 and toward the respective alpha and beta collectors 52 and 70 without any substantial impediments. As indicated, alpha collector 52 and beta collector 70 would preferably be formed in a generally cup shape to correspond with the inner surfaces of the battery sphere (i.e. shell 42), and to facilitate collection and capture of the respective alpha and beta particles. The diameter of volume 35 established by means 30 for separating alpha and beta particles (e.g. magnetic rings 31, 32 and 33) should be large enough to accommodate the diameter of fuel source 20 and leave sufficient additional space (i.e. 26) to enable emitted particles to be separated and directed by the imposed magnetic flux without being substantially hindered by other structures of battery 40. It has been found that providing an inner diameter of magnetic rings 31–33 which is approximately 1.5 times the outer diameter of fuel source 20 should provide sufficient space for proper operation of means 30 for separating and directing alpha and beta particles.

As illustrated, alpha collector 52 and beta collector 70 are mounted within protective shell 42, and are preferably embedded in the structure of gamma collector 85, which substantially surrounds fuel source 20 within protective shell 42. Particularly, gamma collector 85 preferably comprises a relatively thick secondary emitter layer 87 formed of photo emissive material such as Sodium Chloride, which is bonded to an energy absorber or controller layer 89 such as polystyrene. A second secondary emitter layer 91 of photo emissive material such as Sodium Chloride is also bonded to energy absorber layer 89 and which, in turn, is bonded to an outer energy absorber layer 93 such as polystyrene. Bonded to the exterior of second energy absorber layer 93 is gamma collector surface 95, made of a high electro-positivity material having small interatomic radii such as Sulphur, Selenium, or the like.

Gamma collector 85 is provided within the inner surface of protective shell 42 and its inner layer 44 of electrically insulating material to collect and utilize gamma photons and electrons emitted from fuel source 20 and emitter layers 87 and 91 to produce electric current as a result of the photoelectric effect. In particular, first and second secondary emitter layers 87 and 91 are electrically connected to each other in parallel, such as through resistors 86 and 88, respectively (see FIG. 10), to provide a positive electrical terminal, while gamma collector surface 95 provides a negative terminal via electrical lead line 96. Resistors 86 and 88 are preferred to balance out the electrical bias between layers 87 and 91, and to maintain a slight negative bias to prevent inward drifting or migration of electrons within battery 40.

First and second secondary emitter layers 87 and 91 provide photo-emissive layers which, upon impact by emitted gamma photons, release electrons which are ultimately collected on gamma collector surface 95. Electrons released from photo-emissive layers 87 and 91 provide an overall positive charge to terminal 90, while electrons collected by gamma collector surface 95 provide an overall negative charge to terminal 96. By connecting terminals 90 and 96 through a load, current can be provided. The total number of photo-emissive layers (e.g. 87 and 91) will be dictated by the amount of energy to be dissipated before the electrons are collected by collector surface 95 in accordance with the photoelectric effect where:

$$Ek = H \times V - W$$

Where:

H = Planks constant = $4.15 \times 10^{-15}$ eV/sec.

V = frequency of radiation in hertz (Hz)

Ek = kinetic energy of ejected electron

W = ionization potential of the secondary emitter material

Therefore, the velocity of the ejected electron = Ve

Where:

$Ve = SQR\ (Ek/m)$ where: $m$ = mass of electron
Therefore, the wavelength of the ejected electron $= H \times Ve/Ek = H/(m \times Ve)$ and Frequency $(Hz) = 1/\text{wavelength}$ It is known in the industry that the theoretical maximum photo-current is developed utilizing photo-emissive materials such as Sodium Chloride, Cesium-Antimony, Cesium-Oxygen-Silver, Cesium-Pot-assium-Antimony, Cesium-Iodide, or Magnesium Oxide on Silver Magnesium Alloy. Each layer of photo-emissive material (e.g. emitter layers 87 and 91) can also be electrically connected to gamma collector surface 95 to provide a slight negative bias in order to prevent released electrons from drifting radially inward toward fuel source 20, and to allow some electrons to flow back into layers 87 and 91 to replenish displaced electrons.

FIG. 10 represents a schematic diagram of the electrical connections of the various elements of atomic particle battery 40, as described above. In particular, fuel source 20 is substantially centrally mounted within outer protective shell 42 by at least one support rod 46. It is contemplated that support rod 46 can also be preferably utilized to provide connection between fuel source 20 and neutral wire 23 to a neutral connection 22. As mentioned above, providing at least one support rod 46 made of electrically conductive material will enable such neutral connection and can thereby facilitate the provision of a bipolar battery system.

Alpha collector surface 54 provides a positive terminal 55 which can be connected through a load (e.g. a low voltage/high current load ratio device 104), and can be selectively operated such as through switch 102. As mentioned, the ionization of alpha particles resulting from the impact of alpha particles with a collector surface material having an atomic number of 19 or higher will inherently cause the production of helium atoms. Consequently, for proper, long-term operation of particle battery 40, because helium atoms will generally not combine with any of the other materials present in the contemplated structure, it is preferred that means (e.g. vent 60) for removing the gaseous helium be provided, such as through helium vent 60 (see FIGS. 8 and 9). In a preferred arrangement, helium vent 60 comprises a vent opening 61, vent line 62 and a gas pump 63.

As shown in FIG. 10, it is contemplated that the gas pump 63 could be connected via line 64 to the positive terminal 55 of alpha collector 52, thereby utilizing some of the electric potential derived therefrom. Due to the fact that most radioactive materials emit substantially equal numbers of alpha and beta particles during radioactive decay, an overall ratio of approximately two positive charges to one negative charge will naturally tend to build up within battery 40. The second branch 64 of positive terminal 55 is therefore shown as being connected through a load (e.g. auxiliary load 63) to a source of electrons (e.g. the Earth itself is a huge source of electrons due to the fact that the Earth's Van Allen Belt captures electrons in the form of Cosmic Rays) to replenish the electrons being withdrawn from the collector surfaces. Utilization of the second positive branch 64 with an additional negative terminal, such as grounding to the Earth, (e.g., ground 138) significantly increases the potential efficiency of battery 40, as up to one third of the potential electrical current of the system is derived in this way.

As also described above, a thermo-generator or thermo-pile 112 may also preferably be associated with alpha collector 52 to take advantage of the kinetic energy resulting from impact of the alpha particles with alpha collector 52. Thermo-piles which develop current as a result of the heating of two dissimilar metals are well known in the industry, (such as available from Nanmack Corp., Farmingham Center, Me.) and will not be described in detail here. A pair of leads 113 and 114 connected by an appropriately sized capacitor 130 (e.g. to filter out surges or spikes) generally extend from thermo-pile 112 to provide terminals through which additional current can be derived (such as through an auxiliary load 115).

Similarly, beta collector 70 will provide a negative terminal 103 extending from beta collector surface 78. As mentioned above, it is also preferred that secondary emitter surface 74 and beta collector surface 78 be electrically connected (such as through resistor/connection 105) to provide a slight positive bias to emitter surface 74 to prevent the inward radial flow or drifting of electrons toward fuel source 20. As described above with regard to alpha collector 52, the negative terminal of beta collector 70 can be advantageously utilized to provide current through a load (e.g. high voltage/low current load ratio device 108), and can be controlled such as through a switch 106. Similarly, thermo-pile 120 includes terminals 121 and 122, which are preferably connected together through an appropriate filtering capacitor 132 and can be utilized to create additional current, such as through auxiliary load 123.

Electrical terminal/switching assembly 100 indicated in the schematic illustration of FIG. 10 is merely shown as an example of a preferred arrangement for utilizing the potentials provided by the unique separation and collection of alpha and beta particles in the present invention, and can be modified and adapted as necessary for particular applications. As illustrated, terminals 55 and 103 may preferably be connected through appropriate capacitors (e.g., 134 and 136) to neutral wire 23.

As also indicated in FIG. 10, it is preferred that the potential current provided by gamma collector 85 is employed to energize means 30 for separating the alpha and beta particles. In particular, magnetic rings 31, 32 and 33 are illustrated at being connected to positive terminal 90 through connections **90*a*, 90*b*, and 90*c*, respectively. Correspondingly, magnetic rings 31–33 are connected to negative terminal 96 through connections 96*a*, 96*b*, and 96*c*, respectively. While it is contemplated that magnetic rings 31–33 may initially need to be energized by an external source, once atomic particle battery 40 is operating as intended, it is contemplated that the means 30 for separating alpha and beta particles can preferably be electrically connected as the load between the gamma collector terminals (e.g. 90 and 96), and, thereby, energized by the collection of gamma photons as described herein. In this way, atomic particle battery 40** can be self-sustaining following initial start-up procedures.

In operation, magnets 31–33 provide the triaxial, mutually perpendicular and slightly offset magnetic fields having similar effective poles oriented inwardly toward fuel source 20. Consequently, alpha and beta particles emitted by radioactive fuel source 20 are effectively separated and directed toward predetermined collection regions within atomic particle battery 40 along the resultant magnetic field tunnel T, as illustrated best in FIG. 7. The collected alpha and beta particles are utilized in accordance with the electrical diagram of FIG. 10 to directly establish electrical energy potentials which can provide current through connected loads, as indicated. Similarly, means are provided for collecting the gamma particles emitted by fuel source 20, and the electric current obtained from collecting such gamma particles can be utilized to maintain the continued operation of means 30 for separating the alpha and beta particles. As indicated in FIG. 10, diodes (e.g., 140) can be arranged as appropriate in the circuitry to control electron flow as desired.

Description of a practical example of a particle battery 40 which could be made in accordance herewith would start with selection of the fuel source. In particular, the fuel source would be determined based upon certain parameters such as the amount of electric current needed in amperes (I), the atomic mass and half-life of the fuel source, and the density of the fuel source. As an example, we will utilize the element 95 Americium 241 (or Am241), because it is readily available and commonly utilized in ionization-type smoke detector devices. 95 Americium 241 has an approximate density of 15 $gm/cm^3$, and a half-life of 462 years or $1.4579\times10^{10}$ seconds.

It is known that each particular radioactive isotope has a characteristic break-even mass based upon its intensity of emission. The break-even mass of 95 Americium 241 is approximately 75 grams, which can be made into a sphere approximately 21 mm in diameter. This sphere would be bonded onto support rod 46, which itself would be preferably attached to the inner surface of protective shell 42. Using 95 Americium 241 as the parent element of the fuel source 20, this radioactive supply will break down in a family chain of elements emitting 7 alpha particles, 5 beta particles and 8 gamma photons for a total of 29 charges for each breakdown of an individual Am 241 atom before becoming the stable element 83 BI209.

Once the fuel source has been chosen, the materials and relative sizes of each of the other elements of battery 40 can be determined. It is contemplated that an inflatable structure similar to a balloon can be utilized as the form around which the battery can be built. Since the inner diameter of first secondary emitter layer 87 will be the innermost surface of battery elements surrounding fuel source 20, the inflatable structure may be provided with an outer (inflated) diameter corresponding to the inner diameter of emitter layer 87 and approximately equal to the inner diameter of magnetic rings 31–33 (e.g. about 30 mm). It is contemplated that a preferred inflatable structure would also include an outwardly extending surface portion designed to correspond to the size and shape of alpha collector 52. The emitter layer 87 would then be applied to the outer surface of the inflatable structure in the form of Sodium Chloride paste, with the inflatable structure being mounted to or held by a fixture oriented where support rod 46 will extend through emitter layer 78. Before the paste crystalizes and hardens, magnetic rings 31–33 would be situated about the inflatable structure in their desired locations.

As indicated above, the inner diameter of magnetic rings 31–33 has been chosen to be approximately 1.5 times the outer diameter of the fuel source. Utilizing a spherical fuel source having a diameter of about 21 mm, the inside diameter of magnetic rings 31–33 is chosen to be approximately 30 mm. Because the alpha particle requires a higher magnetic field to direct it toward alpha collector 52 (due to its higher mass and charge), the current necessary to produce a magnetic field of sufficient strength to provide an effective magnetic field tunnel T as described above is determined by the maximum energy of any naturally occurring alpha emission (which is about 10 MeV); by determining the space required to allow an alpha particle to curve around fuel source 20 so as not to reenter the fuel source; and by considering the electro-static charge carried by the alpha particle in motion.

In our example, it was determined that the magnetic field strength immediately adjacent fuel source 20 needs to be on the order of approximately $1.3035\times10^{-5}$ Oersted. To achieve this magnetic field strength, the three magnetic rings made of 24 ga. copper wire having 1 revolution around the diameter of volume 35 would need a total current of approximately $3.3013\times10^{-5}$ amps passing through them. These magnetic rings may preferably be pre-formed for use in a battery 40 of particular size and application, and may be made of superconductive material. As mentioned above, it is contemplated that this current can be tapped from the battery output itself, and particularly from leads 90 and 96 of gamma collector 85.

The calculated total Coloumb charge output of 75 grams of 95 Americium 241 is approximately $4.14015\times10^{-5}$ per second, of which the current required for the magnetic rings would tap off approximately $3.3013\times10^{-5}$ Coloumbs, leaving a net useable output of the atomic particle battery 40 of this particular example at approximately $8.388\times10^{-6}$ Coloumbs per second. Obviously, if more fuel was used, higher output could be obtained. Selection of a radioactive fuel source having a more intense rate of breakdown can also increase the useable output of the device. Over a period of time equal to the half-life of the 95 Americium 241 discussed above, the total useable output of a battery made in accordance herewith would be approximately 183,432.887 Coloumbs.

Following crystalization of emitter layer 87 with magnetic rings 31–33 imbedded, an energy absorber layer 89 of polystyrene would be applied such as by spraying. Following proper drying/curing of the polystyrene, a second secondary emitter layer 91 of Sodium Chloride would be applied, probably also in paste form. After crystalization and hardening of layer emitter layer 91, another layer 93 of energy absorbing polystyrene would be sprayed on. While layer 93 is still tacky, it is preferred that gamma collector surface 95 of Sulphur be applied to insure good bonding. It is contemplated that the Sulfur can also be applied by spraying techniques.

Once gamma collector surface 95 has dried, it is preferred to deflate the inflatable structure and remove it from within volume 35 by extraction through an opening left for support rod 46. Thereafter, a tapered opening of proper size and shape to receive beta collector 70 would be cut through the partially completed battery from the exterior, such as by a laser cutter. Once this opening is formed, the recess left on the interior of emitter layer 87 will be accessible for placement of alpha collector 52 thereinto through the opening.

Alpha collector 52 would preferably comprise a preformed plug assembly including an alpha collector surface 54 approximately 1 mm thick of pure Calcium, an insulator layer 56 approximately 2 mm thick of Barium Titanate and a thermo-pile 112, and would comprise approximately 12.5% of the effective inner surface of protective shell 42. Appropriate holes might also be cut at this time to extend terminal lead 55 and leads 113 and 114 to the exterior of the battery from alpha collector 52, as well as to locate helium vent opening 61 adjacent alpha collector 52. Once alpha collector 52 and vent 60 are installed, support rod 46 may be installed through the layers of the gamma collector as described. Support rod 46 may be of any shape, and has a preferable effective diameter of about 2 mm in this example. Obviously, the number and/or size of supports for a particular fuel source and battery could vary between applications.

At this time, fuel source 20 can be installed on support rod 46 through the opening for the beta collector. This step, and all remaining assembly steps are preferably completed by a robot or similar means to properly isolate the radioactive components. Once fuel source 20 is installed, beta collector 70 may be inserted within the opening cut therefor.

Beta collector 70 would also preferably comprise a preformed plug assembly of an approximately 0.5 mm thick energy absorber layer 72 of polystyrene, an approximately 5 mm thick secondary emitter surface 74 of Sodium Chloride, an approximately 0.5 mm thick energy absorber layer 76 of polystyrene, and an approximately 1.5 mm thick beta collector surface 78 made of pure Sulphur. Similarly, an approximately 2 mm thick insulator layer 80 of Barium Titanate would be provided at the rear of beta collector 70. It is contemplated that the total surface area of beta collector 70 will be approximately 24% of the total inner surface of protective shell 42. As indicated, because of the slight spreading of the magnetic field in the direction of beta collector 78, it is preferred that the beta collector 70 be approximately twice as large as alpha collector 52. Similarly, thermo-pile 120 would preferably be connected to insulator layer 80 adjacent beta collector 70.

Gamma collector 85 would preferably comprise an approximately 6.25 mm thick first secondary emitter layer 87 of Sodium Chloride, an approximately 0.5 mm thick energy absorber or controller layer 89 of polystyrene, an approximately 6.25 mm thick second secondary emitter layer 91 of Sodium Chloride, an energy absorber layer 93 approximately 0.5 mm thick of polystyrene, and an approximately 1.5 mm thick gamma collector surface 95 of pure Sulphur. Each of the various resulting layers of alpha collector 52, beta collector 70, and gamma collector 85 would be provided in spherical conformation to appropriately surround fuel source 20 within the inner surfaces of protective shell 42.

Following insertion of beta collector 70 as described, the incomplete portions of second secondary emitter layer 91, energy absorber layer 93, and gamma collector surface 95 would be filled in behind beta collector 70, allowing for outward extension of negative terminal lead 103, and leads 121 and 122, as appropriate. An electrical insulating polymer or similar material 44 would then be spray coated about the entire outer surface of battery 40, followed by the application (such as by vapor deposit) of a radiation shielding layer 42 approximately 2 mm in thickness of lead or similar shielding material. In the specific example presented herein, battery 40 would be approximately 60 mm in outside diameter. As should be understood, the material, thickness, and shape of the outer protective shell 42 is not critical and can be varied according to the requirements of any particular application.

Having shown and described the preferred embodiments of the present invention, further adaptions of the atomic particle battery and method for converting the energy of radioactive decay into electrical energy can be accomplished by appropriate modifications by one of ordinary skill in the art without departing from the scope of the present invention. Several of such potential modifications have been mentioned, and others will be apparent to those skilled in the art.

For example, the amount and type of fuel utilized as the radioactive fuel source in the present invention can be varied to meet specific electric current demands, and the other elements of the particle battery can be correspondingly adjusted and matched to that fuel source and electric current demand. As indicated, the particular materials utilized for the various elements of the particle battery of the present invention are to be chosen based upon the electro-negativity or electro-positivity of the collected particles therewithin. Similarly, collection of gamma photons could be omitted from the device if desired. Also, for stationary terrestrial applications of the atomic particle battery described herein, it may be preferred to orient the polar axis and magnetic tunnel T of the battery to correspond with the Earth's own magnetic axis to achieve optimum efficiency.

Accordingly, the scope of the present invention should be considered in terms of the following claims and is understood not to be limited to the details of structure and operation shown and described in the specification and drawings.

I claim:

1. An apparatus for converting radioactive energy into electrical energy, said apparatus comprising:

an outer radiation protection shell;

a radioactive fuel source located within said shell;

magnetic means for separating alpha and beta particles emitted from said radioactive fuel source, and directing alpha particles to a first predetermined region of said shell while directing beta particles to a second predetermined region for collection and use;

means located adjacent said first region within said shell for collecting alpha particles directed to said first region;

means located adjacent said second region within said shell for collecting beta particles directed to said second region;

means for collecting gamma particles emitted from said radioactive fuel source, wherein electric current is derived from collected gamma particles via a load attached to said gamma collecting means for producing a magnetic field;

means for accommodating gaseous by-product formed within said shell; and output means for utilizing said collected alpha and beta particles to create electric current.

2. The apparatus of claim 1, wherein said means for separating alpha and said beta particles comprises electromagnetic devices, and wherein at least a portion of the current for energizing said electromagnetic devices is obtained from said gamma collecting means.

3. The apparatus of claim 1, wherein said means for collecting gamma particles comprises a secondary emissive layer and a collector surface.

4. The apparatus of claim 1, wherein said means for collecting gamma particles comprises a collector surface located adjacent the inner surface of said shell, said collector surface covering substantially the entire inner surface of said shell.

5. The apparatus of claim 3, wherein electrical current is derived from collected electrons and gamma particles via a load connected between said secondary emissive layer and said collector surface of said gamma collecting means.

6. The apparatus of claim 1, wherein said fuel source is mounted at the center of said shell by at least one mounting rod.

7. The apparatus of claim 1, further comprising means associated with one or more of the alpha and beta particle collecting means for converting thermal energy from said collecting means into electrical energy.

8. The apparatus of claim 7, wherein said converting means are provided for both said alpha and beta collecting means, and wherein said converting means further comprises a thermo-pile device.

9. The apparatus of claim 1, wherein said beta collecting means is approximately twice as large as said alpha collecting means.

10. An apparatus for converting radioactive energy of particles emitted during radioactive decay into electrical energy, said apparatus comprising:

an outer radioactive protective shell having outer and inner surfaces;

a radioactive fuel source located within said shell;

means for separating alpha and beta particles emitted from said radioactive fuel source and directing alpha particles to a first predetermined region of said shell while directing beta particles to a second predetermined region, said separating means further comprising means for providing three mutually perpendicular ring-like magnetic fields having like poles of each of the ring-like magnetic fields facing inwardly within said shell;

means within said shell and located radially outward from said fuel source for collecting alpha particles directed to said first region of said shell;

means within said shell and located radially outward from said fuel source for collecting beta particles directed to said second region of said shell;

means for removing gaseous by-product from within said shell; and output means for utilizing said collected alpha and beta particles to create electric current.

11. The apparatus of claim 10, further comprising means for collecting gamma particles emitted from said radioactive fuel source.

12. The apparatus of claim 10, wherein said means for providing ring-like magnetic fields comprises an electromagnetic device.

13. The apparatus of claim 12, wherein current to energize said electromagnetic is at least in part obtained from said gamma collecting means.

14. An apparatus for converting radioactive energy of particles emitted during radioactive decay into electrical energy, said apparatus comprising:

an outer radioactive protective shell having an outer and an inner face;

a radioactive fuel source located adjacent the center of said shell;

means for separating alpha and beta particles emitted from said radioactive fuel source and directing alpha particles to a first predetermined region of said shell while directing beta particles to a second predetermined region, said separating means further comprising means for providing three mutually perpendicular ring-like magnetic fields having like poles of each of the ring-like magnetic fields facing inwardly within said shell, the center of said ring-like magnetic fields being offset from said fuel source;

means within said shell for collecting alpha particles directed to said first region of said shell;

means within said shell for collecting beta particles directed to said second region of said shell;

means for removing gaseous by-product from within said shell;

output leads for utilizing said collected alpha and beta particles to create electric current; and means for collecting gamma particles emitted from said radioactive fuel source.

15. The apparatus of claim 14, wherein said means for providing ring-like magnetic fields comprises an electromagnetic device.

16. The apparatus of claim 15, wherein current to energize said electromagnetic is at least in part obtained from said gamma collecting means.

17. A method for converting radioactive energy in the form of particles released during radioactive decay into electrical energy, said method comprising the following steps;

providing a radioactive fuel source located within an outer radiation protection shell;

providing a magnetic field for separating alpha and beta particles emitted from said radioactive fuel source;

directing the separated alpha particles to a first predetermined region within said shell, and beta particles to a second predetermined region within said shell;

providing means located adjacent said first region within said shell for collecting alpha particles directed to said first region, and means located adjacent said second region within said shell for collecting beta particles directed to said second region;

collecting said separated alpha and beta particles within said shell with said alpha collecting means and said beta collecting means, respectively;

directing said collected alpha and beta particles through respective load circuits to provide electrical current; and providing means for collecting gamma particles emitted from said radioactive fuel source, and producing electric current from said gamma particle collecting means by connecting a load thereto.

18. The method of claim 17 further comprising the step of removing gaseous by-product from within said shell.

19. The method of claim 17, wherein said means for collecting gamma particles comprises a secondary emissive layer and a collector surface located within said shell, and further comprising the step of connecting said collector surface to said secondary emissive layer via a load to produce additional electrical current.

20. The method of claim 19, comprising the additional step of providing electric current from said means for collecting gamma particles to said means for separating said alpha and beta particles to energize said separating means.

21. The method of claim 17, further comprising the steps of:

providing means connected to at least one of said alpha and beta collecting means for converting thermal energy from said collecting means into electrical energy; and converting thermal energy from said collecting means into electrical current.

22. An apparatus for converting radioactive energy into electrical energy, said apparatus comprising:

an outer radioactive protective shell;

a radioactive fuel source located within said shell;

means for separating alpha and beta particles emitted from said radioactive fuel source and directing alpha particles to first predetermined region of said shell while directing beta particles to a second predetermined region, said means for separating alpha and beta particles including ring-like magnetic fields having like poles facing inwardly into said shell, said ring-like magnetic fields being offset from the center of said fuel source;

means located adjacent said first region within said shell for collecting alpha particles directed to said first region;

means located adjacent said second region within said shell for collecting beta particles directed to said second region;

means for accommodating gaseous by-product formed within said shell; and output means for utilizing said collected alpha and beta particles to create electric current.

23. The apparatus of claim 22, wherein said means for providing three mutually perpendicular magnetic fields comprises three magnetic rings, each of said magnetic rings providing an essentially cylindrical magnetic field toward said fuel source oriented with like poles facing inwardly.

24. The apparatus of claim 23, wherein said ring-like magnetic fields each have their effective north pole facing inwardly.

25. An apparatus for converting radioactive energy into electrical energy, said apparatus comprising:

an outer radiation protection shell;

a radioactive fuel source located within said shell;

means for separating alpha and beta particles emitted from said radioactive fuel source and directing alpha particles to a first predetermined region of said shell while directing beta particles to a second predetermined region, said means for separating said alpha and beta particles comprising a set of three triaxially oriented, mutually perpendicular magnetic rings, said magnetic rings mounted within said shell and having like poles oriented inwardly;

means located adjacent said first region within said shell for collecting alpha particles directed to said first region;

means located adjacent said second region within said shell for collecting beta particles directed to said second region;

means for accommodating gaseous by-product formed within said shell; and output means for utilizing said collected alpha and beta particles to create electric current.

26. An apparatus for converting radioactive energy into electrical energy, said apparatus comprising:

an outer radiation protection shell;

a radioactive fuel source located within said shell, said fuel source mounted at the center of said shell by at least one mounting rod formed of electrically conductive material to enable bipolar operation of said apparatus;

means for separating alpha and beta particles emitted from said radioactive fuel source and directing alpha particles to a first predetermined region of said shell while directing beta particles to a second predetermined region;

means located adjacent said first region within said shell for collecting alpha particles directed to said first region;

means located adjacent said second region within said shell for collecting beta particles directed to said second region;

means for accommodating gaseous by-product formed within said shell; and output means for utilizing said collected alpha and beta particles to create electric current.

27. An apparatus for converting radioactive energy into electrical energy, said apparatus comprising:

an outer radiation protection shell;

a radioactive fuel source located within said shell, said fuel source mounted at the center of said shell;

means for separating alpha and beta particles emitted from said radioactive fuel source and directing alpha particles to a first predetermined region of said shell while directing beta particles to a second predetermined region;

means located adjacent said first region within said shell for collecting alpha particles directed to said first region;

means located adjacent said second region within said shell for collecting beta particles directed to said second region;

means for accommodating gaseous by-product formed within said shell;

output means for utilizing said collected alpha and beta particles to create electric current; and means for collecting gamma particles emitted from said radioactive source, said gamma collecting means comprising a secondary emissive layer, a collector surface, and a moderator layer of material located between said secondary emissive layer and said collector surface to facilitate collection of particles.

* * * * *